US007458707B2

(12) United States Patent
de Lamberterie

(10) Patent No.: US 7,458,707 B2
(45) Date of Patent: Dec. 2, 2008

(54) HEADLAMP OPTICAL MODULE FOR A MOTOR VEHICLE

(75) Inventor: Antoine de Lamberterie, Paris (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 11/746,770

(22) Filed: May 10, 2007

(65) Prior Publication Data

US 2007/0263402 A1 Nov. 15, 2007

(30) Foreign Application Priority Data

May 12, 2006 (FR) ..... 06 04386

(51) Int. Cl.
*F21V 33/00* (2006.01)

(52) U.S. Cl. ..... 362/520; 362/509; 362/309; 362/327; 362/328

(58) Field of Classification Search ..... 362/509, 362/521, 522, 520, 308, 309, 327, 328
See application file for complete search history.

(56) References Cited

U.S. PATENT DOCUMENTS 6,282,822 B1 * 9/2001 Rinzler et al. ..... 40/590
6,776,513 B2 * 8/2004 Albou ..... 362/507
2005/0190572 A1 * 9/2005 Komatsu et al. ..... 362/538
2005/0225995 A1 10/2005 Komatsu et al.

FOREIGN PATENT DOCUMENTS

| | | |
|---|---|---|
| DE | 10115868 A1 | 10/2002 |
| JP | 2003203508 | 7/2003 |
| JP | 2003338210 | 11/2003 |

* cited by examiner

*Primary Examiner*—Laura Tso
(74) *Attorney, Agent, or Firm*—Jacox, Meckstroth & Jenkins

(57) ABSTRACT

Headlamp optical module for a motor vehicle comprising, disposed along an optical axis: an elliptical-type reflector with at least one light source placed in the vicinity of a first focal point of the reflector; a converging lens placed in front of the reflector and admitting a focal point located in the vicinity of the second focal point of the reflector; and a light recovery means suitable for collecting a portion of the flux from the source and for sending it forward. An ellipsoid-type reflector is provided at the front, in the upper portion of the module, this reflector focusing a portion of the rays issuing from the source in the vicinity of a second focal point located at the front, lower than the focal point of the lens, and the light recovery means has an input face, in proximity to which is located the second focal point of the ellipsoid-type reflector.

16 Claims, 4 Drawing Sheets

HEADLAMP OPTICAL MODULE FOR A MOTOR VEHICLE

CROSS-REFERENCE TO RELATED APPLICATIONS

This application claims priority to French Application No. 0604386 filed May 12, 2006, which application is incorporated herein by reference and made a part hereof.

BACKGROUND OF THE INVENTION

I. Field of Invention

The invention relates to a headlamp optical module for a motor vehicle of the type of those which comprise, disposed along an optical axis:

an elliptical-type reflector with at least one light source placed in the vicinity of a first focal point of the reflector;

a converging lens placed in front of the reflector and admitting a focal point located in the vicinity of the second focal point of the reflector, or combined therewith.

II. Description of the Related Art

A headlamp can be composed of one or more, similar or differing optical modules.

In a light headlamp module of this type, a portion of the light flux emitted by the source is lost. Efforts have therefore been made to improve the performance levels of elliptical-type optical systems, in particular with a xenon or halogen source, with a significant light contribution in zones of the beam requiring this contribution.

JP 2003 338210 proposes to improve the performance levels of the elliptical technology using a light recovery means capable of collecting a portion of the light flux directed downward and originating from the source and of sending it toward the front of the vehicle.

However, the part made of transparent material, glass or plastics material forming the light recovery means according to JP 2003 338210 is of a large size which is incompatible with industrial molding conditions and makes this part difficult to implant in a light headlamp. The inlet of the part is of fresnelised shape in order to collimate the rays, and this inlet is of considerable size. Accordingly, it becomes difficult to modify the beam, for example, for an AFS application, by masking this zone as a large surface area has to be concealed.

The collimation of the rays and the guarantee of obtaining a cut-off in the beam require optimum adjustment of the position of the part relative to the source, rendering the mechanical production of the system complex.

There is, therefore, a need to provide an improved optical module that overcomes one or more problems in the prior art.

SUMMARY OF THE INVENTION

The object of the invention is, above all, to provide an elliptical-type headlamp module in which the recovery of light is improved and efficiency increased in a simple manner in terms of implementation.

According to the invention, an optical headlamp module for a vehicle of the type defined hereinbefore which comprises, in its low portion, a light recovery means suitable for collecting a portion of the flux from the source (in particular heading toward the rear) and for sending it forward, is such that:

an ellipsoid-type reflector or mirror (6) is provided at the front, in the upper portion of the module, this reflector (6) focusing a portion of the rays issuing from the source (E) in the vicinity of a second focal point ($\mu_2$) located at the front, lower than the focal point (FL) of the lens (L), and the light recovery means has an edge in proximity to the second focal point of the elliptical mirror forming the cut-off edge.

The term "an 'ellipsoid-type' headlamp" refers to a reflector which is substantially ellipsoidal in shape or the behavior of which is related/comparable to that of an ellipsoid reflector. The same applies to the "elliptical-type" reflector. "High" or "low" are terms to be understood for the module in the configuration which it has in the headlamp in the position in which it is fitted in the vehicle.

Advantageously, the upper front portion of the elliptical reflector is stopped in the region of a zone corresponding to the end rays which, after reflection onto the reflector, are collected as limit rays by the lens.

Preferably, the recovery means is made of a one-piece transparent material. The recovery means comprises an input face inclined on the optical axis of the headlamp, having an upper limit forming the cut-off edge. The input face of the recovery means is disposed so that the rays reflected by the ellipsoid-type reflector and falling onto this input face are hardly deflected. This input face is preferably substantially planar.

The recovery means can be limited in its low portion by an inclined surface, in particular an inclined plane, operating in total reflection, the rays being straightened by the recovery means in order especially—on average—to be substantially parallel to the optical axis of the output face of the recovery means.

Advantageously, the output face of the recovery means is generated by revolution about the optical axis. The output face can admit as the meridian vertical section an elliptic arc, one focal point of which is the image, provided by the inclined plane, of the second focal point of the ellipsoid-type reflector, in order to form an emerging beam admitting a planar wave surface, substantially orthogonal to the optical axis.

According to a further possibility, the output face admits as the horizontal section that of a given quadric to provide at the output a cylindrical wave plane having substantially vertical generatrices.

The light headlamp module can comprise a movable shield in the region of the input face of the recovery means, this shield being able to be placed in a withdrawn position, in which it allows the light to pass toward the input face, or to occupy a position in which it blocks out this light.

This module can be mounted so as to be movable and the recovery means can be fixed and placed in such a way that in the rest position of the headlamp the light originating from the additional ellipsoid-type reflector passes beside the recovery means, whereas in the operating position the headlamp is positioned facing the recovery means which then becomes active.

The light headlamp module can comprise a shield located between the reflector and the lens, limited by an end edge, forming a cut-off edge, located in the vicinity of the focal point of the lens.

The recovery means can comprise an input face which is inclined on the optical axis and the upper limit of which is formed by an edge passing through the focal point of the system formed by a planar mirror and the dioptre of the output face.

The recovered beam can be a beam without a cut-off, the recovery means comprising an input face which is inclined on the optical axis and the upper limit of which is formed by an edge not passing through the focal point of the ellipsoid-type reflector or through the focal point of the system consisting of the planar mirror and the dioptre of the output face.

According to a further possibility, the recovered beam is a variable beam, the recovery means comprising an input face inclined on the optical axis with a movable shield in front of the face.

BRIEF DESCRIPTION OF THE DRAWINGS

The invention consists, apart from the provisions set out hereinbefore, of a certain number of further provisions which will be referred to hereinafter more explicitly with regard to embodiments which are described with reference to the enclosed drawings but do not entail any limitation. In these drawings.

DETAILED DESCRIPTION OF THE PREFERRED EMBODIMENTS

Figure 1:
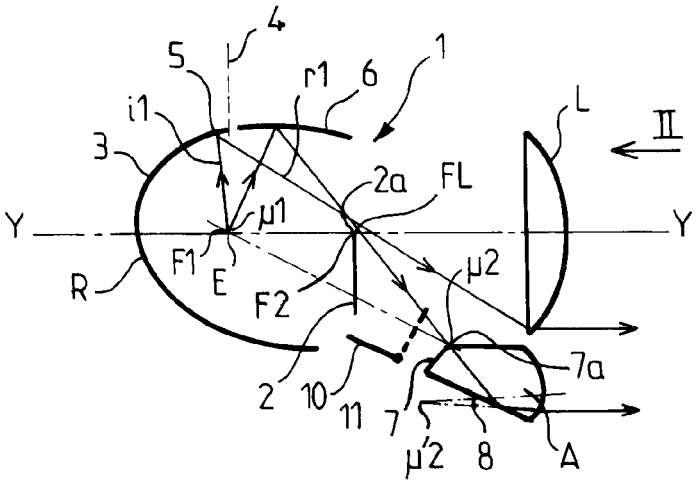
FIG. 1 is a vertical schematic section passing through the optical axis of a headlamp according to the invention.
Figure 2:
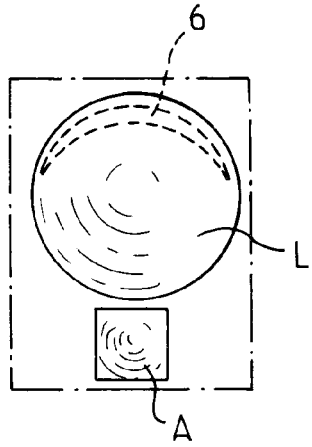
FIG. 2 is a schematic view in the direction of arrow II in FIG. 1.

FIG. 1 of the drawings schematically illustrates a light headlamp module 1 comprising, along its optical axis Y-Y, an elliptical-type reflector R with at least one light source E placed in the vicinity of a first focal point F1, or the internal focal point of the reflector, of which the second focal point F2, or external focal point, is located further forward. The terms "front" and "back" are to be understood in view of the direction in which the light spreads which, according to FIG. 1, goes from left to right.

A converging lens L is placed in front of the reflector R and admits a focal point FL combined with the second focal point F2 or located in the vicinity of this second focal point F2 of the reflector R.

A shield 2 is located between the reflector R and the lens L. In the example illustrated in FIG. 1, this shield 2 is formed by a screen orthogonal to the, normally horizontal, optical axis Y-Y. This shield 2, located in a vertical plane, is limited in its high portion by an upper edge 2*a*, forming a cut-off edge, located in the vicinity of the focal point FL of the lens L, or passing through this focal point FL.

In a variation, the vertical shield 2 could be replaced with a horizontal folder cutting off the beam.

A light recovery means A is provided in the low portion of the lens L to collect a portion of the flux, originating from the light source E, directed downward and to send it forward.

The upper portion 3 of the reflector R beyond a zone 4 loses its effectiveness:

- either the reflector R is calculated to lead the reflected rays to pass in proximity to the shield 2 and the focal point FL: in this case, the light rays issue from the lens L;
- or the reflector R is calculated to cause the rays to return into the lens L; in this case, the light rays pass through the top of the shield 2 and are drawn markedly downward after passing through the lens. They then cause an excess of near-parasitic or worse-than-parasitic light when the rays issuing from the lens L with a marked drawdown encounter aluminized-type parts of the headlamp.

In practice, the zone 4 is defined by a plane orthogonal to the axis Y-Y adjacent to a point such as point 5 of the reflector R. The point 5 is of the type sending a light ray i1, originating from the first focal point F1, in the direction of a reflected ray r1 arriving on the lower edge of the lens L. The rays originating from the light source E and falling onto the reflector R at points located in front of the point 5 will be reflected in the direction of the rays issuing from the lens L.

It will be noted that the light source E is extended and that the reflector R is not necessarily focused at the center of the light source E. The "limit" rays pass at the lens edge and have to be drawn down by a sufficient angle (about 15 degrees) after issuing from the lens L. This condition determines in a unique manner the passage of the limit ray in the plane of the shield 2 at a point Δ.

As the lighting beams have a thickness of 10° to at most 15°, all rays in front of the zone 4:

- either pass above the point Δ and then have a chance to return into the lens L, but they are drawn down by an angle of greater than 15° and are therefore useless;
- or pass below the point Δ, in which case they issue from the lens L.

According to the invention, the upper portion 3 of the reflector R is cut in the vicinity of the zone 4 and is extended by an ellipsoid-type reflector 6, referred to in a simplified manner as the "elliptical mirror", which admits a first focal point μ1 in the vicinity of the light source E and a second focal point μ2 located in front, lower than the optical axis Y-Y and than the focal point FL of the lens L. The second focal point μ2 can be located almost in the same vertical region as the lower edge of the lens L, although this is not necessary.

The mirror 6 focuses the light rays which it receives from the light source E toward the second focal point μ2 located between the lens L and the reflector R.

The light recovery means A is made of a transparent material, glass or plastics material such as polymethacrylate. It is disposed in the low portion of the lens L and comprises an edge 7*a*, orthogonal to the plane of FIG. 1 which passes through the second focal point μ2 of the mirror 6.

The light recovery means A is of one piece and has an input face 7 designed so that the light rays sent by the mirror 6 and falling onto this input face 7 are deflected little or not at all on entering the light recovery means A. This input face 7 is basically planar and, for example, substantially orthogonal to the mean direction of the beam originating from the mirror 6. The input face 7 is inclined on the optical axis Y-Y and its upper limit forms the edge 7*a* passing through the focal point of the system consisting of the inclined plane 8 and the output face S1, which will be described in greater detail. This configuration is necessary to fulfill a function additional to the cut-off function. However, the invention encompasses the various cases in which the recovered beam is:

- either a beam without a cut-off, in which case the edge 7*a* does not pass through the second focal point μ2 or through the focal point of the system consisting of the mirror 6 and the dioptre of the output face S1;
- or a variable beam, having a movable shield 10 in front of the input face 7: the movable shield 10 can be either in a position in which the entire input face 7 is shielded and nothing is recovered; or in a position in which the edge of the movable shield 10 passes through the second focal point μ2, in which case a cut-off beam is recovered; or in a position in which a large portion of the input face 7 is free beyond the second focal point μ2, in which case a beam without a cut-off is obtained.

The low portion of the light recovery means A is limited by an inclined plane 8 inclined from the back toward the front. The inclination of this inclined plane 8 is provided to ensure total reflection of the rays which originated from the mirror 6 and entered the light recovery means A. The rays are straightened by the light recovery means A in order—on average—to be parallel to the optical axis of the output face of the light recovery means A.

This output face can assume a plurality of forms and be defined by a plurality of equations.

In a first case, it may be desirable for any light ray issuing from the second focal point μ2 to emerge parallel to the optical axis Y1-Y1 of the light recovery means A, parallel to the optical axis Y-Y. The output face S1 therefore has to be generated by revolution about the optical axis Y1-Y1. The rays reflected by the inclined plane 8 seem to originate from a point μ'2 (FIG. 3) which is the image of second focal point μ2 provided by the inclined plane 8. The output face S1 focuses all the rays issuing virtually from point μ'2. Any ray issuing from the second focal point μ2, and therefore virtually from point μ'2, proceeds in the axis parallel to Y1-Y1. The output face S1 therefore transforms a spherical wave surface issuing from point μ'2 into a planar wave surface P, orthogonal to the optical axis Y1-Y1, as illustrated in horizontal projection in FIG. 4.

Figure 3:
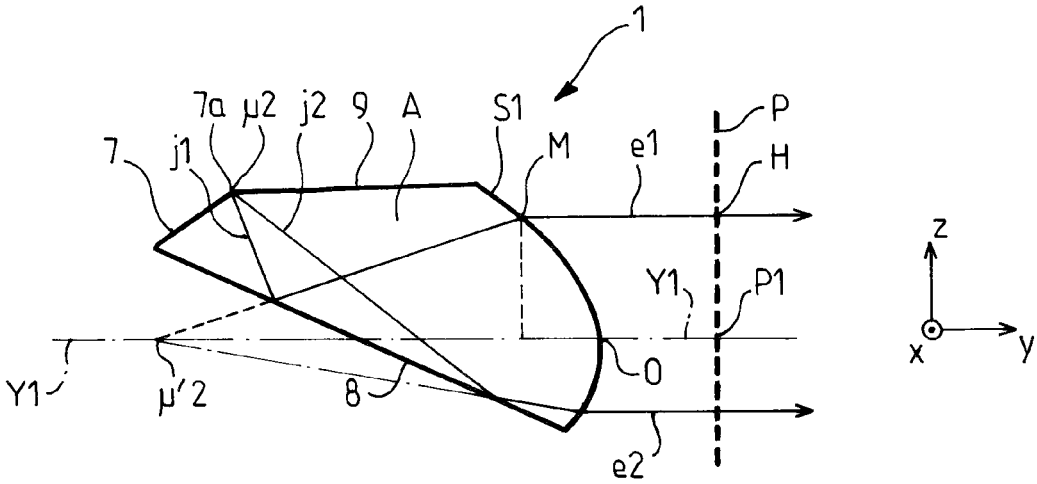
FIG. 3 is a vertical schematic section on a larger scale of the recovery means according to the invention.

FIG. 3 shows two light rays j1, j2 which issue from the second focal point μ2 and, after being reflected onto the inclined plane 8 and refracted when crossing the output face S1, issue in the direction of the rays e1 and e2 parallel to Y1-Y1.

By considering a reference trirectangular trihedron in accordance with which the axis of the x's is perpendicular to the plane of FIG. 3, the axis of the y's is horizontal and the axis of the z's is vertical and by specifying the constancy of the optical path between the second focal point μ2 and a planar wave surface P, orthogonal to Y1-Y1, the equations set out hereinafter are obtained, n being equal to the index of refraction of the material of the light recovery means A.

For any point M on the output face S1:

$$n\times\overline{\mu'_2M}+\overline{MH}=\overline{OP_1}+n\times\overline{\mu'_2O}$$

wherein P1 is the intersection of the optical axis Y1-Y1 and the planar wave surface P and H is the intersection of the ray issuing through M with the planar wave surface P.

On the one hand, by selecting P1 so as to be combined with O, the peak of the output face S1, and by specifying that $\mu'_2O=f$ and, on the other hand, by taking the origin of the marker at O, the following is obtained:

$$n\times\sqrt{(yM-f)^2+zM^2+xM^2}+yM=n\times f$$

(xM, yM and zM being the coordinates following Ox, Oy and Oz of the point M).

Figure 4:
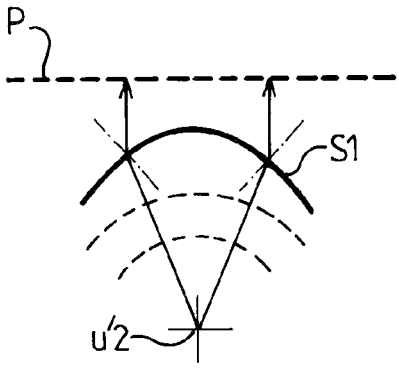
FIG. 4 is a horizontal projection of the transformation of a spherical wave surface into a planar wave surface by the recovery means of FIG. 3.

This is the equation of an ellipsoid, one of the focal points of which is none other than point μ'2 (FIG. 4).

If the mirror 6 (FIG. 1) extending the reflector R is a perfect ellipsoid, the lighting at the input of the light recovery means A is highly focused, in particular along the edge 7*a* perpendicular to the plane of FIGS. 1 and 3. The output face S1 focuses all the rays, leading at the output to a cluster of parallel rays e1, e2 that is highly concentrated in width. Such a concentration in width may not be desirable.

To widen the beam issuing from the output face S1, it is conceivable to widen the spot at the edge 7*a* of the light recovery means A. However, a solution of this type is not desirable as, on the one hand, the light recovery means A becomes larger and, on the other hand, the light losses greater owing to the curvature of the output face S1.

Figure 5:
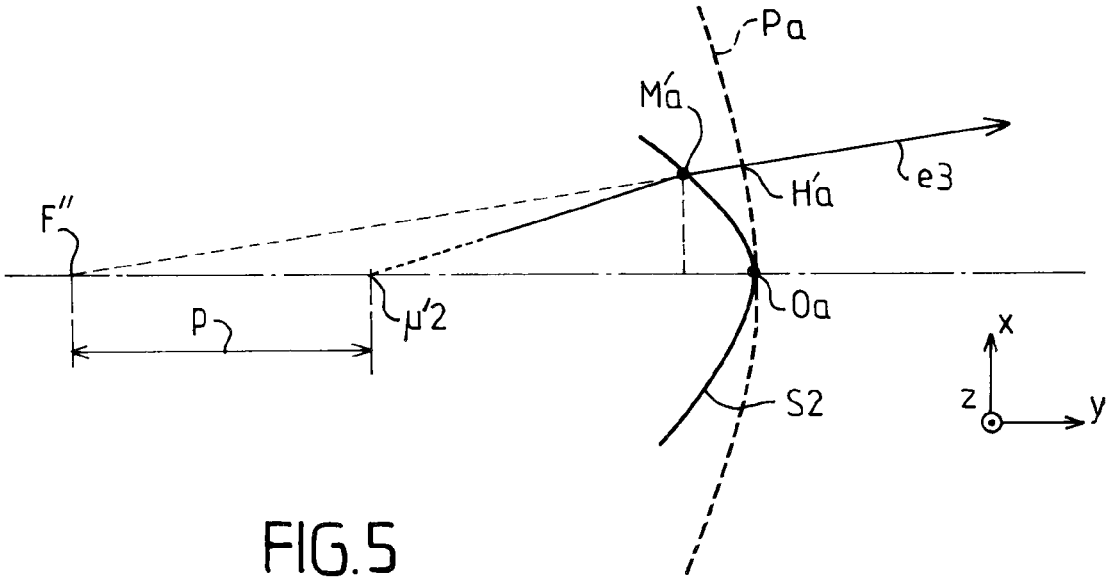
FIG. 5 is a schematic section through a horizontal plane of a variation of the recovery means from FIG. 3 for obtaining a widened beam.

The invention proposes an advantageous solution consisting in designing an output face S2 (FIG. 5) which allows the vertical deflection properties of the output face S1 from FIGS. 1 and 3 to be maintained while widening the beam in the horizontal planes.

The output face S2 is determined in such a way that the wave surface $P_a$ is no longer planar, as in the case of FIGS. 3 and 4, but rather cylindrical with vertical generatrices.

Figure 6:
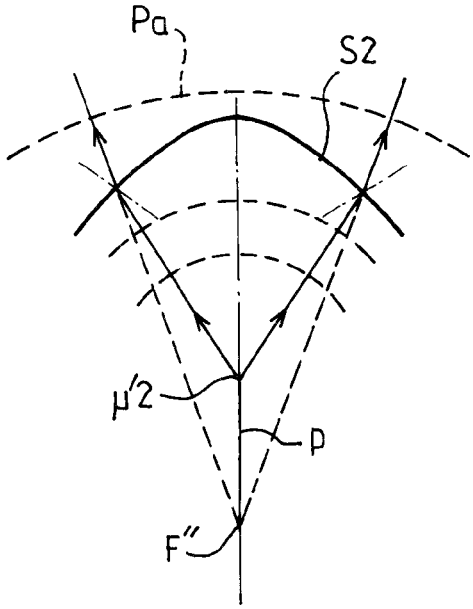
FIG. 6 is a horizontal projection illustrating the beam having a cylindrical wave surface obtained with the recovery means from FIG. 5.

The paths of the light rays in a vertical plane are identical to the illustration of FIG. 3. In a horizontal plane, on the other hand, corresponding to the plan view of FIG. 5, the tracing of the wave surface $P_a$ on the horizontal plane can be considered as a circle, the center of which is located at a point F". The distance $p=\mu'_2F''$ then determines the width of the spot, i.e. the opening angle of the beam in the horizontal plane. The light rays issuing from the output face S2 have projections on a horizontal plane such as end rays e3 (FIG. 5) that are orthogonal to the wave surface $P_a$ and therefore correspond to radii of the circle passing through the center F". FIG. 6 illustrates in horizontal projection the wave surface $P_a$.

If p has a low value, the radius of the wave surface $P_a$ is also low and the end rays e3 are markedly divergent, so the spot or opening angle of the beam is large. If, on the other hand, p is large, the spot contracts. When p tends toward infinity, the output face S2 is reduced to the output face S1 of FIG. 3.

As for the output face S1 of FIG. 3, the equation of the output face S2 is written by expressing the preservation of the optical path:

for any point $M_a$ pertaining to the output face S2:

$$n\times\overline{\mu'_2M_a}+\overline{M_aH_a}=n\times\overline{\mu'_2O_a}=n\times f \quad (1)$$

n is the index of refraction of the material of the recovery means, $H_a$ is the intersection of the ray issuing through $M_a$ with the surface $P_a$ and $O_a$ is the peak of output face S2. As $H_a$ is located on the cylinder of center F" and of radius R, the projections on the horizontal plane of F", of $M_a$ and of $H_a$ pertain to a single straight line. By designating as $M'_a$ and $H'_a$ the projections of $M_a$ and $H_a$ on the horizontal plane, there is obtained, taking F" as the origin:

for any point $M_a$ pertaining to the output face S2:

$$\overline{M'_aH'_a}=\overline{F''H'_a}-\overline{F''M'_a}=R-\sqrt{(yM_a-p)^2+xM_a^2} \quad (2)$$

$\overline{M_aH_a}$ can be replaced by $\overline{M'_aH'_a}$ then, at the output face S2, the radius is calculated to be found in a horizontal plane parallel to the plane Oxy, the condition for forming the horizontal cut-off. Accordingly, the projections $\overline{M'_aH'_a}$ onto Oxy are indeed equal to $\overline{M_aH_a}$ By incorporating Equation (2) into Equation (1), the following is obtained: for any point $M_a$ pertaining to the output face S2:

$$n\times\overline{\mu'_2M_a}+R-\sqrt{(yM_a-p)^2+xM_a^2}=n\times f$$

$$\text{i.e } n\times\sqrt{(yM_a^2+xM_a^2+zM_a^2)}+R-\sqrt{(yM_a-p)^2+xM_a^2}=n\times f \quad (3)$$

This is a quadric which is solved by setting polar coordinate parameters.

The last element of the light recovery means A is the high portion 9 joining the input face 7 to the output face S1, S2. It will be noted that this high portion is joined to the input face 7 in the region of the focal point located on the edge 7*a*. This allows a cut-off to be formed in the light beam in two different manners.

According to a first manner, the high portion 9 is coated with a black paint so as to prevent the light rays from entering through this high portion 9. Only the rays passing below the edge 7*a* and below $\mu_2$ issue through output face S1 or through output face S2, hence the formation of a cut-off.

According to a second manner, it is advantageous to overmold the transparent light recovery means A with an opaque material on the high portion 9. An overmolding process of this type is conventional and allows the blocking-out part to be positioned with a high degree of precision relative to the light recovery means A. Furthermore, the blocking-out part can also have a mechanical function allowing the light recovery means A to be positioned and fixed relative to the light module.

Figure 7:
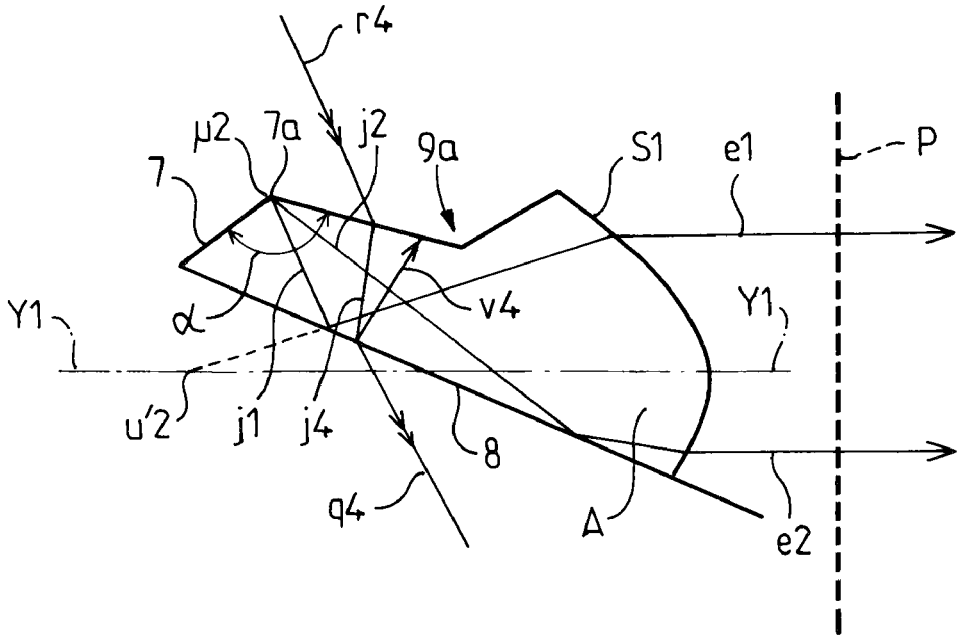
FIG. 7 is a schematic vertical section of a variation of the recovery means from FIG. 3.

According to a further possibility, there is defined a high portion 9*a* (FIG. 7) allowing a shield to be dispensed with while at the same time providing the desired cut-off.

Specifically, the high portion 9*a* forms, with the input face 7 of the light recovery means A, an angle a sufficiently large to allow rays such as r4 arriving on the high portion 9*a* to be markedly deflected in the direction of rays such as j4. The rays j4 arrive on the inclined plane 8 no longer with an incidence ensuring total reflection but rather at an incidence close to the normal. The major portion issues in the direction of rays such as q4 which are lost and do not return to the forward-projected beam. As a small fraction of a ray j4 can be reflected at v4, it may prove necessary to place a shield, to prevent any parasitic influence, on the high portion 9*a* toward the front, but not necessarily on the edge of the input face 7.

Figure 8:
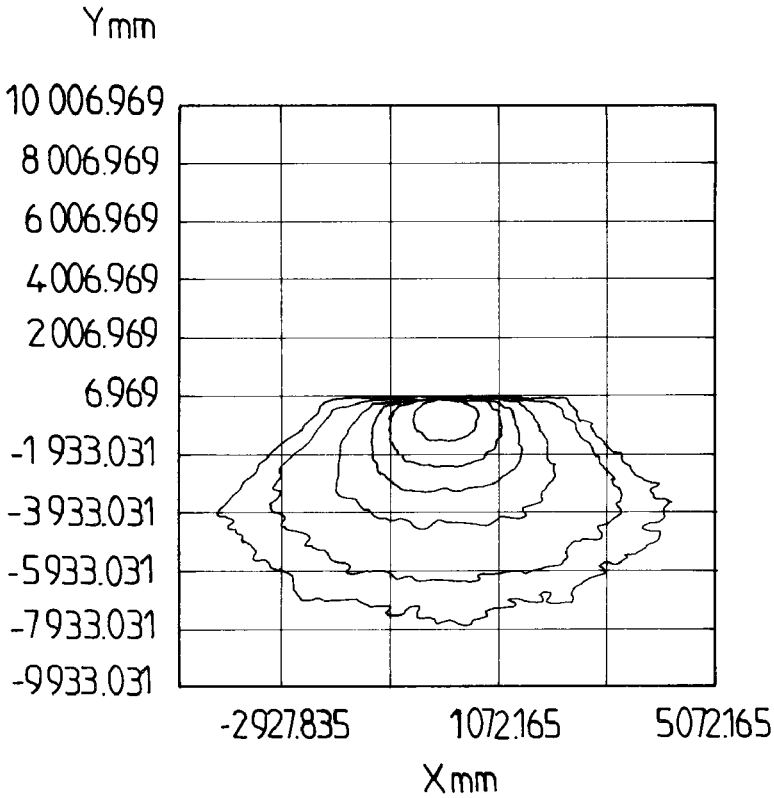
FIG. 8 is a schematic illustration of the network of isolux curves obtained with the recovery means from FIG. 3.

FIG. 8 illustrates the network of isolux curves obtained on a screen placed at 25 m from the headlamp in the case in which the light recovery means A has an output face S1 (FIG. 3). The cluster of isolux curves is fairly concentrated in terms of width, in practice a width of ±2 m at 25 m, i.e. an opening angle of ±4.5 degrees (arc tangent 2/25=4.5 degrees). The beam, on the other hand, is very thick (vertical dimension). Its thickness can be limited by limiting merely the size of the input face.

Figure 9:
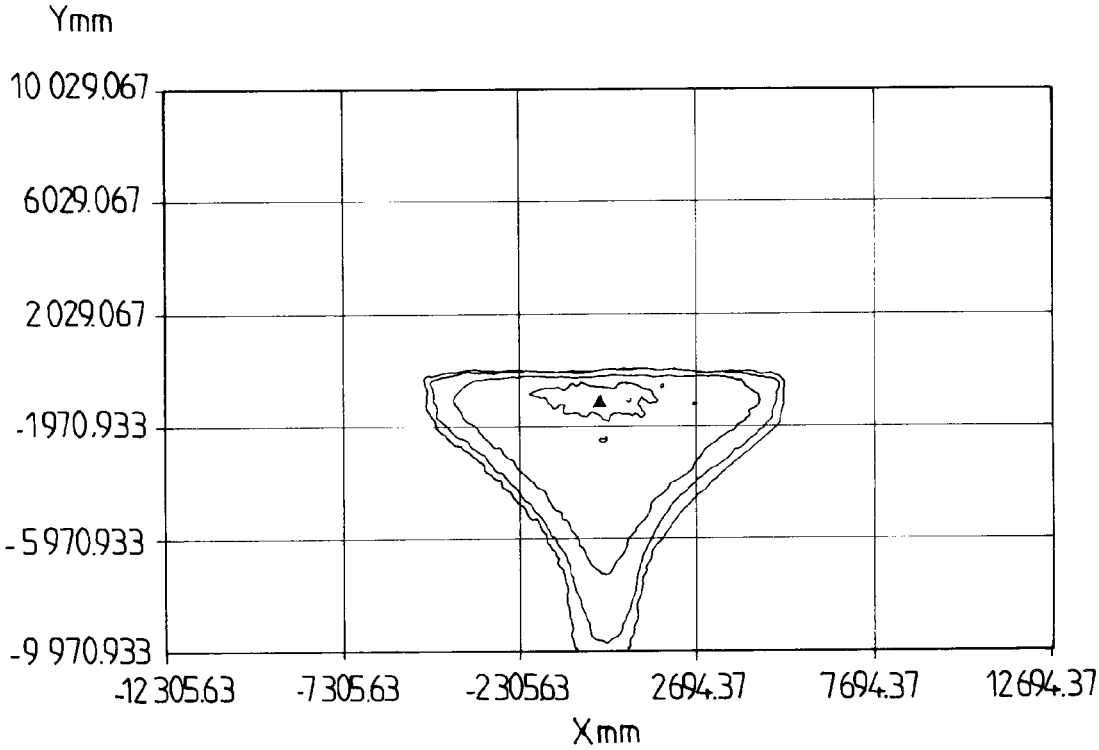
FIG. 9 is a schematic illustration of a further network of isolux curves obtained with the recovery means from FIG. 5.

In the case of a light recovery means A with the output face S2 (FIG. 5), a wider isolux network can be obtained (FIG. 9) without a loss of flux with a width of approximately ±5 m at 25 m, i.e. an opening angle of ±11 degrees (arc tangent 5/25=11 degrees). It is possible to go beyond this.

Apart from the formation of the cut-off, the recovery of light obtained owing to the invention provides good flexibility to change the features of the beam. This can be attained as disclosed hereinafter.

According to a first possibility, a movable shield 10 (FIG.1), for example a shield mounted so as to be able to rotate about axis 11 perpendicular to the plane of FIG. 1, is provided in the region of the input face 7 of the light recovery means A. The movable shield 10 can be in a withdrawn position indicated by solid lines in FIG.1, in which it allows the light to pass toward the input face 7, or conversely occupy the position indicated by broken lines, in which it blocks out this light.

According to a second possibility, the entire module or headlamp is caused to move, for example by rotation about a vertical axis. This is what happens when the module is mounted on a DBL ("dynamic bending light") rotating plate. The light recovery means A can then be positioned and designed in such a way that in the rest position of the module, i.e. with the optical axis Y-Y parallel to the longitudinal axis of the vehicle, the light originating from the additional elliptical mirror passes beside the recovery means. In the operating position, on the other hand, when the module on its DBL plate has rotated relative to the longitudinal axis of the vehicle, the module is then positioned facing the light recovery means A which then becomes active.

Figure 10:
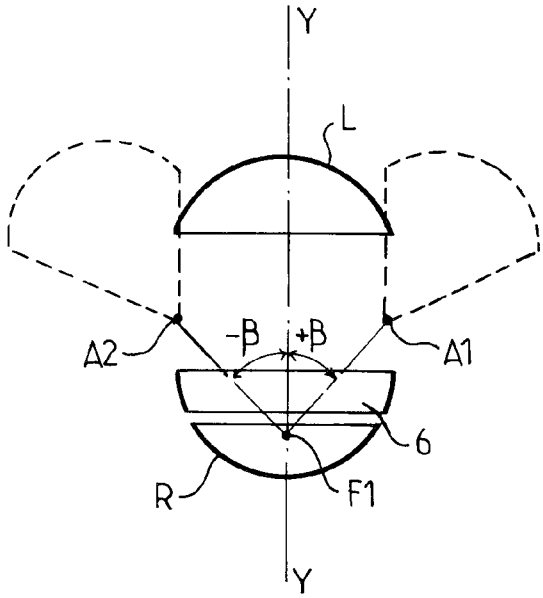
FIG. 10 is a schematic plan view of a DBL headlamp according to the invention.

FIG. 10 illustrates schematically an arrangement of this type. Two recovery means A1, A2 are fixed either side of the optical axis Y-Y of a module or headlamp movable in rotation about a vertical axis. The straight line joining the first focal point F1 of the reflector R and the environment of the edge of each recovery means A1, A2 forms an angle ±β with the optical axis Y-Y when the optical axis is parallel to the longitudinal axis of the vehicle.

In the position illustrated in FIG. 10, the optical axis Y-Y of the module is parallel to the longitudinal axis of the vehicle and the light issuing from the mirror 6 extending the reflector R passes beside each of the recovery means A1, A2 which are therefore inactive.

When the driver turns his wheels, to the right for example in order to negotiate a bend, the module turns and the light issuing from the module will reach the recovery means A1 completely once the optical axis Y-Y has turned through an angle β. The light recovered by the recovery means A1 then allows the lighting to be improved within the bend. The recovery means A2 would intervene for a left bend.

The recovery means A, A1 or A2 according to the invention consists of a small part which can easily be made of glass or of plastics material. Furthermore, the production and the formation of the cut-off of the beam is not dependent on the position of the recovery means relative to the module, hence there is highly flexible tolerance on the position of the recovery means.

The additional light flux is obtained without adding an additional light source.

The invention provides an original style. The increase in the range of the light beam may be very much greater than that obtained with shield movements in known headlamps.

The flexibility of the solution of the invention provides varied forms of isolux network. A movable shield such as movable shield 10 utilizes merely a very simple mechanical system.

The invention can also supplement rotating shield systems. In other words, the invention is fully compatible with systems used for bifunctional dipped and full-beam headlamps (bi-halogens or bi-xenons for example). This allows much higher performance level values. The light source can have a transverse or axial configuration relative to the optical axis of the module.

The examples given for the output faces S1, S2 do not entail any limitation.

The invention provides a clear cut-off of the beam, without achromatism, with a one-piece recovery means which itself manages the cut-off. The solution of the invention allows the range of a headlamp on a motorway to be increased, in particular, by adding a band of fine light very far away from the vehicle and by eliminating/reducing any excessive near light.

The gain in light flux provided by the invention is significant. For example, with a xenon lamp-type source, for a dipped beam having a light flux of 1,000 lumens, approximately 100 lumens are added in accordance with the invention. With regard to lighting, this results in a gain of approximately 30 lux at 25 m, passing from approximately 50 to 80 lux.

There are a relatively large number of applications.

For a motorway headlamp, the output face of the recovery means tends to be elliptical and the input face is relatively narrow. A movable shield 10 is generally provided which is withdrawn for motorway driving.

The FBL ("fixed bending light") application also employs a shield which is withdrawn when a surplus of lighting is desired.

According to a further possibility, the recovery means is combined with a DBL ("dynamic bending light") and the elliptical module is able to rotate whereas the recovery means is fixed.

The invention is also suitable for applications such as:

bi-halogen (dipped and full-beam) headlamp with the recovery means portion forming a wide and thick beam;

transverse filament headlamp, which has the advantage of being highly effective, the amount of flux recovered being very considerable.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A headlamp optical module for a motor vehicle comprising, disposed along an optical axis:

an elliptical-type reflector with at least one light source placed in a vicinity of a first focal point of the elliptical-type reflector;

a converging lens placed in front of said elliptical-type reflector and admitting a focal point located in a vicinity of a second focal point of the elliptical-type reflector, or combined therewith;

and, in its low portion, a light recovery means suitable for collecting a portion of the flux from said light source and for sending it forward, said headlamp optical module comprising:

an ellipsoid-type reflector provided at a front, in an upper portion of said headlamp optical module, said ellipsoid-type reflector focusing a portion of rays issuing from said at least one light source in said vicinity of said second focal point located at said front, lower than a focal point of said converging lens, and said light recovery means comprising an input face, in proximity to which is located said second focal point of said ellipsoid-type reflector.

2. The optical module according to claim 1, wherein the upper front portion of said elliptical-type reflector located above the optical axis is stopped in the region of a zone corresponding to the end rays which, after reflection onto said elliptical-type reflector, are collected as limit rays by said converging lens.

3. The optical module according to claim 1, wherein said light recovery means is made of a one-piece transparent material.

4. The optical module according to claim 1, wherein said light recovery means comprises an input face inclined on the optical axis of said headlamp optical module, having an upper limit.

5. The optical module according to claim 3, wherein said input face of said light recovery means is disposed so that the rays reflected by the ellipsoid-type reflector and falling onto said input face are hardly or minimally deflected.

6. The optical module according to claim 1, wherein said input face of said light recovery means is substantially planar.

7. The optical module according to claim 1, wherein said light recovery means is limited in its low portion by an inclined surface operating in total reflection, the rays being straightened by said light recovery means such that on average, they become substantially parallel to the optical axis of an output face of said light recovery means.

8. The optical module according to claim 1, wherein an output face of said light recovery means is generated by revolution about said optical axis.

9. The optical module according to claim 7, taken in conjunction with each other, wherein said output face admits as the meridian vertical section an elliptic arc, one focal point of which is the image provided by the inclined plane of the second focal point ($\mu_2$) of the ellipsoid-type reflector, in order to form an emerging beam admitting a planar wave surface, substantially orthogonal to the optical axis.

10. The optical module according to claim 1, wherein said output face admits as the horizontal section that of a given quadric to provide at the output a cylindrical wave plane having substantially vertical generatrices.

11. The optical module according to claim 1, which comprises a movable shield in the region of said input face of said light recovery means, said movable shield being able to be placed in a withdrawn position, in which it allows the light to pass toward the input face, or to occupy a position in which it blocks out this light.

12. The optical module according to claim 1, wherein the headlamp optical module is mounted so as to be movable and said light recovery means is fixed and placed in such a way that in the rest position of the headlamp the light originating from said additional ellipsoid-type reflector passes beside said light recovery means, whereas in the operating position the headlamp is positioned facing said light recovery means which then becomes active.

13. The optical module according claim 1, which comprises a shield located between said ellipsoid-type reflector and said converging lens, limited by an end edge, forming a cut-off edge, located in the vicinity of the focal point of said converging lens.

14. The optical module according to claim 7, wherein said light recovery means comprises an input face which is inclined on the optical axis and the upper limit of which is formed by an edge passing through the focal point of the system formed by the planar mirror and the dioptre of the output face.

15. The optical module according to claim 7, wherein a recovered beam is a beam without a cut-off, said light recovery means comprising an input face which is inclined on the optical axis and the upper limit of which is formed by an edge not passing through the focal point of the ellipsoid-type reflector or through the focal point of the system consisting of the planar mirror and the dioptre of the output face.

16. The optical module according to claim 7, wherein a recovered beam is a variable beam, said light recovery means comprising an input face inclined on the optical axis with a movable shield in front of the face.

* * * * *